US009419367B2

(12) United States Patent
Henry et al.

(10) Patent No.: US 9,419,367 B2
(45) Date of Patent: Aug. 16, 2016

(54) PLUGGABLE CONNECTOR HAVING MULTIPLE HOUSING SHELLS

(71) Applicant: Tyco Electronics Corporation, Berwyn, PA (US)

(72) Inventors: Randall Robert Henry, Harrisburg, PA (US); Robert Harrison Wertz, Jr., Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 24 days.

(21) Appl. No.: 14/266,453

(22) Filed: Apr. 30, 2014

(65) Prior Publication Data

US 2015/0318634 A1 Nov. 5, 2015

(51) Int. Cl.

| | |
|---|---|
| ***H01R 24/00*** | (2011.01) |
| ***H01R 13/506*** | (2006.01) |
| ***H01R 13/502*** | (2006.01) |
| ***H01R 24/60*** | (2011.01) |
| ***H01R 9/03*** | (2006.01) |
| *H01R 13/6583* | (2011.01) |
| *H01R 12/63* | (2011.01) |

(52) U.S. Cl.

CPC ..... *H01R 13/506* (2013.01); *H01R 9/034* (2013.01); *H01R 13/502* (2013.01); *H01R 24/60* (2013.01); *H01R 12/63* (2013.01); *H01R 13/6583* (2013.01)

(58) Field of Classification Search

CPC ..... H01R 13/502; H01R 13/514; H01R 24/60
USPC ..... 439/76.1, 465, 467, 607.41, 607.46, 439/607.47, 607.48, 497, 579, 108, 620.23, 439/676

See application file for complete search history.

(56) References Cited

U.S. PATENT DOCUMENTS

| | | | | |
|---|---|---|---|---|
| 5,545,054 | A | 8/1996 | Benes et al. | |
| 6,059,602 | A | 5/2000 | Ward | |
| 6,146,198 | A * | 11/2000 | Maeda | 439/587 |
| 6,428,361 | B1 * | 8/2002 | Imschweiler et al. | 439/676 |
| 6,744,963 | B2 * | 6/2004 | Hwang | 385/139 |
| 6,758,699 | B1 * | 7/2004 | Hwang et al. | 439/676 |
| 7,033,204 | B1 * | 4/2006 | Wang | H01R 13/6335 385/147 |
| 7,033,219 | B2 * | 4/2006 | Gordon et al. | 439/607.41 |
| 7,083,336 | B2 * | 8/2006 | Kim | G02B 6/4292 385/88 |
| 7,090,527 | B2 * | 8/2006 | Hanley | G02B 6/4292 439/372 |
| 7,387,538 | B2 * | 6/2008 | Engel | H01R 13/6658 439/620.23 |
| 7,883,341 | B2 * | 2/2011 | Lang | H01R 13/6593 439/465 |
| 8,064,207 | B2 * | 11/2011 | Wu | G06K 13/08 361/726 |

(Continued)

*Primary Examiner* — Tulsidas C Patel
*Assistant Examiner* — Peter G Leigh

(57) ABSTRACT

Pluggable connector including a contact array of electrical contacts for engaging corresponding contacts of a communication component. The pluggable connector also includes a connector housing having a mating end configured to mate with the communication component. The connector housing includes a first housing shell and a second housing shell that oppose each other and are coupled together to define a housing cavity therebetween. The contact array is disposed within the housing cavity. The first housing shell includes a plug collar that surrounds the contact array at the mating end. The plug collar has a leading edge and a back edge. The second housing shell interfaces with the back edge of the plug collar such that the plug collar extends from the second housing shell to the mating end.

19 Claims, 7 Drawing Sheets

(56) References Cited

U.S. PATENT DOCUMENTS 8,202,122 B2 * 6/2012 Wu ..... H01R 13/6581 439/352
8,251,735 B2 * 8/2012 Wu ..... H01R 13/5825 439/353
8,403,698 B2 * 3/2013 Su et al. ..... 439/455
8,537,558 B2 * 9/2013 Su ..... H01R 9/032 361/740
8,668,515 B2 * 3/2014 Wu ..... H01R 13/633 439/352
8,770,990 B2 * 7/2014 Sytsma ..... H01R 9/034 439/76.1
2003/0228799 A1 * 12/2003 Machado ..... H01R 13/6658 439/607.01

* cited by examiner

PLUGGABLE CONNECTOR HAVING MULTIPLE HOUSING SHELLS

BACKGROUND

The subject matter herein relates generally to a pluggable connector having a connector housing formed from multiple housing shells.

Pluggable cable assemblies may be used to transfer data to and from different communication systems or devices. Known cable assemblies include serial attached (SA) small computer system interface (SCSI) cable assemblies, which may also be referred to as SAS cable assemblies. Such cable assemblies may include a pluggable connector having a mating end and a trailing end. The mating end is inserted into a receptacle assembly of the communication system, and the trailing end receives a cable of the cable assembly. In some cases, the pluggable connector includes a circuit board that has electrical contacts, such as contact pads, that are exposed at the mating end. The circuit board may be mechanically and electrically coupled to wire conductors of the cable. During a mating operation, the mating end is inserted into a cavity of the receptacle assembly. The electrical contacts at the mating end engage corresponding electrical contacts of a mating connector within the cavity.

Pluggable connectors may include a connector housing that is formed from multiple housing shells. For example, first and second housing shells may be joined together to define a housing cavity therebetween. The circuit board is positioned within the housing cavity between the first and second housing shells. In at least one known pluggable connector, the first and second housing shells include respective leading portions that are joined with each other to form the mating end of the pluggable connector. An elongated fastener secures the leading portions to each other.

While the elongated fastener may be effective in securing the leading portions together, the process of applying the elongated fastener may damage the housing shells. For example, applying the elongated fastener with excessive force may cause a crack in one or both of the housing shells. The crack(s) may cause a decrease in electrical performance and/or a decrease in an operating lifetime of the pluggable connector. In addition to the above, the elongated fastener(s) may occupy space within the pluggable connector that could be used for other purposes.

Accordingly, there is a need for a pluggable connector in which the leading portions of the housing shells are not joined using a fastener that extends through the housing cavity and engages the leading portions.

BRIEF DESCRIPTION

In an embodiment, a pluggable connector is provided that includes a contact array of electrical contacts for engaging corresponding contacts of a communication component. The pluggable connector also includes a connector housing having a mating end configured to mate with the communication component. The connector housing includes a first housing shell and a second housing shell that oppose each other and are coupled together to define a housing cavity therebetween. The contact array is disposed within the housing cavity. The first housing shell includes a plug collar that surrounds the contact array at the mating end. The plug collar has a leading edge and a back edge. The second housing shell interfaces with the back edge of the plug collar such that the plug collar extends from the second housing shell to the mating end.

In certain aspects, the connector housing may have a trailing end and a central longitudinal axis that extends between the mating and trailing ends through the housing cavity. The plug collar may surround the longitudinal axis and have at least one plug wall that extends substantially parallel to the longitudinal axis. Optionally, the at least one plug wall includes multiple plug walls that extend substantially parallel to the longitudinal axis. The leading edge of the plug collar may completely surround the longitudinal axis.

In certain aspects, the pluggable connector includes a circuit board having opposite side edges with the contact array positioned therebetween. The plug collar engages each of the side edges to hold the circuit board.

In an embodiment, a pluggable connector is provided that includes a circuit board having a contact array of electrical contacts configured to engage corresponding contacts of a communication component. The pluggable connector also includes a connector housing having a first housing shell and a second housing shell that oppose each other and are coupled together to define a housing cavity therebetween. The circuit board is disposed in the housing cavity. The connector housing has a mating end and a trailing end and a central longitudinal axis extending therebetween through the housing cavity. The second housing shell includes a front edge that faces toward the mating end and engages the circuit board. The front edge of the second housing shell is configured to block the circuit board from moving backward toward the trailing end during a mating operation with the communication component.

In certain aspects, the first housing shell includes a plug collar that surrounds the circuit board at the mating end. The plug collar may have a leading edge and a back edge. The second housing shell interfaces with the back edge of the plug collar such that the plug collar extends from the second housing shell to the mating end. In some cases, the front edge of the second housing shell constitutes a portion of the second housing shell that is closest to the mating end.

DETAILED DESCRIPTION

Figure 1:
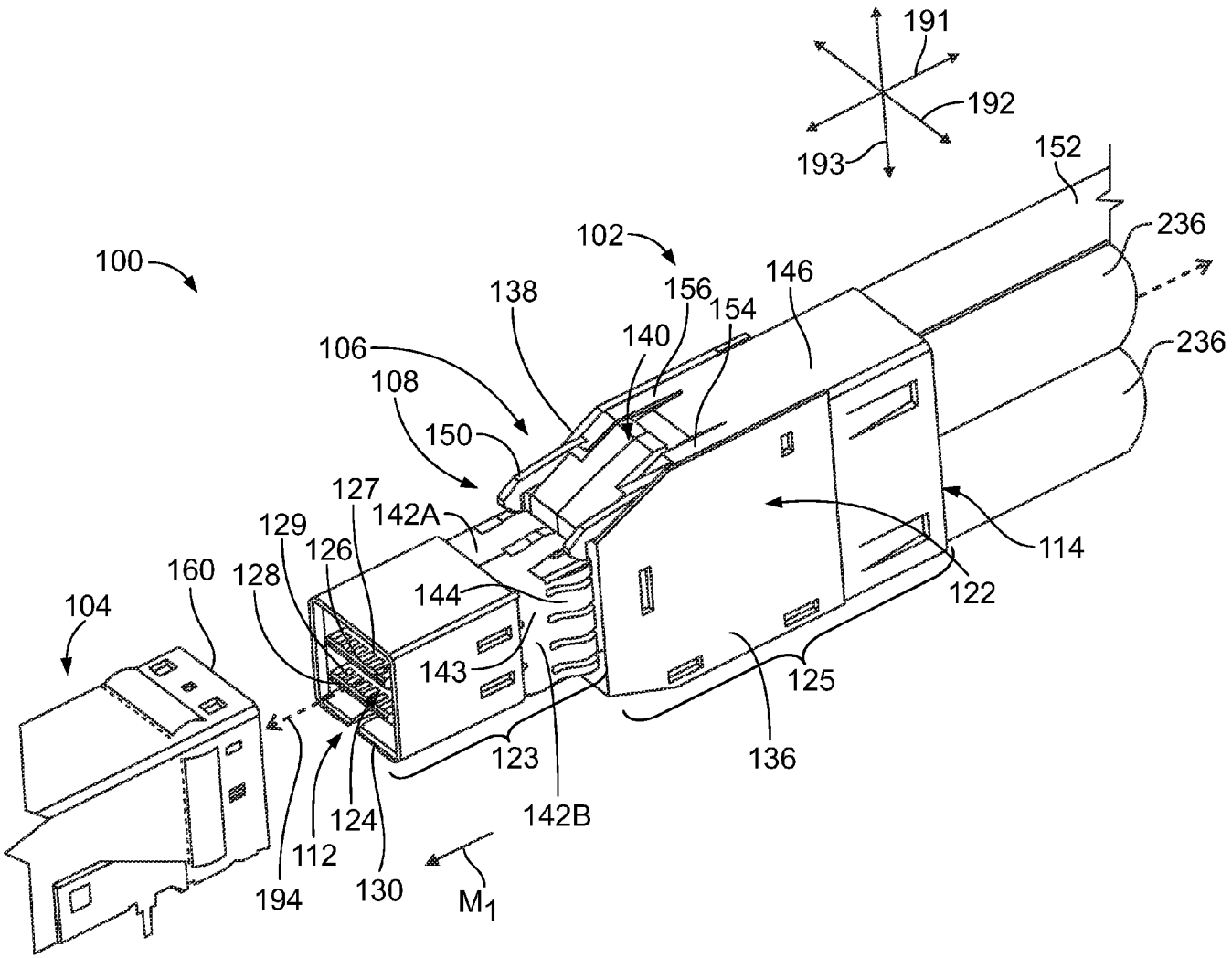
FIG. 1 is a perspective view of a communication system that includes a pluggable connector formed in accordance with an embodiment.

FIG. 1 is a perspective view of a communication system 100 formed in accordance with an embodiment that includes a cable assembly 102 and a communication component or device 104 that are configured to engage each other. The cable assembly 102 includes a pluggable connector 106 and a pair of communication cables 236 attached to the pluggable connector 106. Other embodiments may include only one communication cable 236 or more than one communication cable 236. Although not shown, the cable assembly 102 may include another pluggable connector 106 at an opposite end of the communication cables 236. The pluggable connector 106 has a connector housing 122 that includes a mating end 112 and a trailing end 114. The mating and trailing ends 112, 114 may face in opposite directions along a central longitudinal axis 194 of the pluggable connector 106. The communication cables 236 are coupled to and/or inserted through the trailing end 114 of the connector housing 122. In certain embodiments, the pluggable connector 106 may include a coupling mechanism 108 that is coupled to the connector housing 122.

For reference, the communication system 100 is oriented with respect to mutually perpendicular axes 191-193, including a mating axis 191, a lateral axis 192, and an elevation axis 193. In FIG. 1, the pluggable connector 106 is oriented such that the longitudinal axis 194 is parallel to the mating axis 191. In the illustrated embodiment, the communication component 104 is a receptacle assembly having a cavity (not shown) for receiving a portion of the pluggable connector 106. The communication component 104 is hereinafter referred to as the receptacle assembly 104, but it is understood that the pluggable connector 106 may engage or mate with other communication components.

The mating end 112 of the connector housing 122 is configured to be inserted into the cavity of the receptacle assembly 104. To insert the mating end 112 into the receptacle assembly 104, the pluggable connector 106 is aligned with respect to the cavity of the receptacle assembly 104 and advanced toward the receptacle assembly 104 in a mating direction $M_1$. The mating end 112 is inserted into the receptacle assembly 104 and advanced toward a mating connector (not shown) disposed within the cavity. The pluggable connector 106 and the receptacle assembly 104 may form a pluggable engagement. The coupling mechanism 108 may removably couple the pluggable connector 106 to the receptacle assembly 104 and prevent the pluggable connector 106 and the receptacle assembly 104 from being inadvertently disengaged such that data transmission is interrupted.

Figure 2:
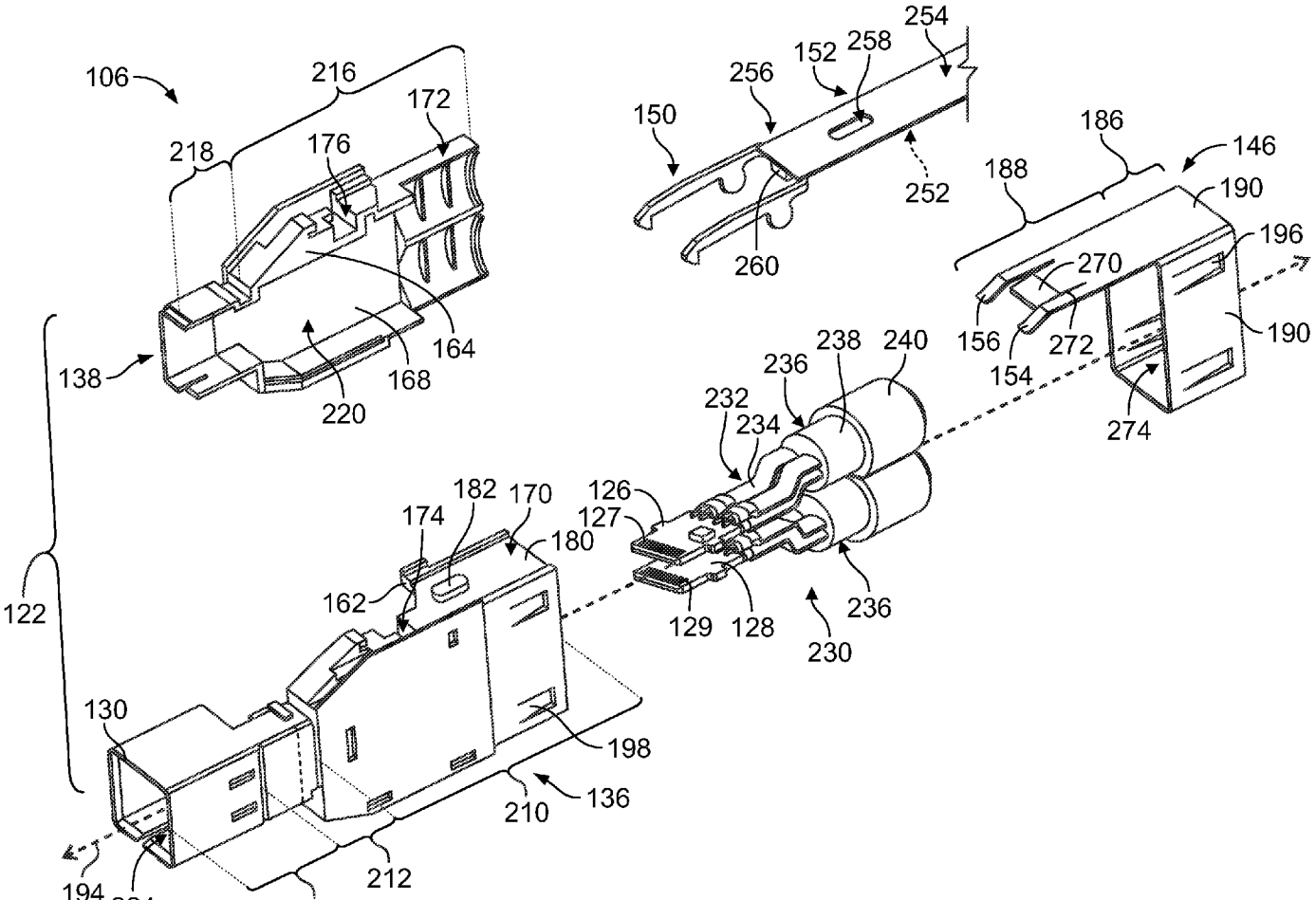
FIG. 2 is a partially exploded view of the pluggable connector of FIG. 1.

The communication cables 236 are coupled to the pluggable connector 106 at the trailing end 114. As shown in FIG. 2, each of the communication cables 236 includes insulated wires 232 having jackets 234. The jackets surround wire conductors 235 (FIG. 3), which are configured to transfer data signals and/or electrical power. In other embodiments, the communication cables 236 may have optical fibers that are configured to transmit data signals in the form of optical signals.

Returning to FIG. 1, the pluggable connector 106 may be characterized as an input/output (I/O) module that is capable of being repeatedly inserted into and removed from the cavity of the receptacle assembly 104. The communication system 100, the cable assembly 102, and/or the pluggable connector 106 may be configured for various applications. Non-limiting examples of such applications include host bus adapters (HBAs), redundant arrays of inexpensive disks (RAIDs), workstations, rack-mount servers, servers, storage racks, high performance computers, or switches. The communication system 100 may be, or may be part of, an external serially attached (SA) small computer system interface (SCSI). In such embodiments, the cable assembly 102 may be referred to as a serially attached SCSI (SAS) cable assembly. The cable assembly 102 may be configured for one or more industry standards, such as SAS 2.1 in which the cable assembly 102 may be capable of transmitting six (6) gigabits per second (Gbps) for each lane. In more particular embodiments, the cable assembly 102 may be configured for SAS 3.0 and/or at 12 Gbps or more per lane. The pluggable connector 106 may be configured to be compliant with small form factor (SFF) industry standards, such as SFF-8644 or SFF-8449 HD. In some embodiments, the cable assembly 102 may be similar to the cable assembly used with the Mini SAS HD Interconnect, which is available from TE Connectivity.

The connector housing 122 forms a housing cavity 124 that opens to the mating end 112. The longitudinal axis 194 may extend through an approximate center of the housing cavity 124. The connector housing 122 has an insert portion 123 that is sized and shaped to be inserted into the cavity of the receptacle assembly 104, and a body portion 125 that is not inserted into the cavity of the receptacle assembly 104. The insert portion 123 includes a leading edge 130 of the connector housing 122 at the mating end 112. The body portion 125 may be configured to be gripped by an individual.

In the illustrated embodiment, the pluggable connector 106 includes two circuit boards 126, 128 having electrical contacts 127, 129, respectively. The circuit boards 126, 128 are disposed within the housing cavity 124. The electrical contacts 127, 129 are configured to engage corresponding electrical contacts (not shown) of the communication connector in the receptacle assembly 104. In some embodiments, the electrical contacts 127, 129 are contact pads of the circuit boards 126, 128, respectively. In alternative embodiments, however, the electrical contacts 127, 129 may be other types of electrical contacts, such as contact beams.

As shown, the connector housing 122 has first and second housing shells 136, 138. The first and second housing shells 136, 138 may be molded from, for example, a conductive material or may include one or more conductive platings. The first and second housing shells 136, 138 may engage each other along a seam 140. When coupled to each other, the first and second housing shells 136, 138 may define the housing cavity 124 therebetween. For instance, the housing cavity 124 may extend from the mating end 112 to the trailing end 114 between the first and second housing shells 136, 138. In an exemplary embodiment, the first and second housing shells 136, 138 are not symmetrical. Instead, the first housing shell 136 constitutes a majority of the connector housing 122. However, the first and second housing shells 136, 138 may have other configurations in alternative embodiments. Yet in other embodiments, the connector housing 122 has more than two shells.

The pluggable connector 106 may also include a pair of shield frames or skirts 142A, 142B that are coupled to the insert portion 123 to effectively surround the insert portion 123. The shield frames 142A, 142B include corresponding base portions 143 and spring tabs or fingers 144. The base portions 143 are secured to the insert portion 123. The spring tabs 144 extend from the corresponding base portions 143 and are configured to engage an interior surface (not shown) of the receptacle assembly 104 when the insert portion 123 of the pluggable connector 106 is inserted into the receptacle assembly 104. As shown, the spring tabs 144 may extend in a rearward direction from the corresponding base portions 143 toward the trailing end 114 and be located adjacent to the body portion 125. The spring tabs 144 may be deflected toward the insert portion 123 when the insert portion 123 is inserted into the receptacle assembly 104. The shield frames 142 may electrically ground an exterior of the insert portion 123 to reduce unwanted effects from electromagnetic interference (EMI). In other embodiments, a single shield frame may surround the entire insert portion 123.

In some embodiments, the pluggable connector 106 includes a connector retainer 146 that is coupled to the connector housing 122. The connector retainer 146 engages the first and second housing shells 136, 138 to secure the first and second housing shells 136, 138 to each other and form the connector housing 122. In an exemplary embodiment, the connector retainer 146 entirely surrounds an exterior of the connector housing 122 about the longitudinal axis 194. In other embodiments, the connector retainer 146 may only partially surround the connector housing 122. In an exemplary embodiment, the connector retainer 146 is stamped and formed from sheet metal. However, the connector retainer 146 may be manufactured in other manners.

The coupling mechanism 108 includes a latch assembly 150 and an operator-controlled actuator 152. In some embodiments, the coupling mechanism 108 may also include a portion of the connector retainer 146. For example, the connector retainer 146 may include multiple biasing fingers 154, 156. In other embodiments, the coupling mechanism 108 may include only one biasing finger. The biasing fingers 154, 156 extend toward the mating end 112 and engage the latch assembly 150. The latch assembly 150 is configured to move between an open position and a closed position as described in U.S. patent application Ser. No. 14/193,185, which is incorporated herein by reference in its entirety. FIG. 1 illustrates the latch assembly 150 in a closed position.

During the mating operation, when the insert portion 123 is almost entirely within the receptacle assembly 104, a housing edge 160 of the receptacle assembly 104 may engage the latch assembly 150 thereby causing the latch assembly 150 to rotate to the open position. The biasing fingers 154, 156 of the coupling mechanism 108 engage the latch assembly 150 when the latch assembly 150 is in the open position and urge the latch assembly 150 back toward the closed position. Accordingly, in some embodiments, the connector retainer 146 secures the first and second housing shells 136, 138 together while also holding the latch assembly 150 in the closed position. In alternative embodiments, the connector retainer 146 may only secure the first and second housing shells 136, 138 together without engaging the latch assembly 150.

FIG. 2 is a partially exploded view of the pluggable connector 106. In particular, FIG. 2 illustrates the first and second housing shells 136, 138, the latch assembly 150, the operator-controlled actuator 152, the connector retainer 146, and an interior communication sub-assembly 230. The first and second housing shells 136, 138 include inner surfaces 162, 164, respectively, that are configured to border each other when the first and second housing shells 136, 138 are joined. The first housing shell 136 has an interior surface 166 (shown in FIG. 4), and the second housing shell has an interior surface 168. The interior surfaces 166, 168 define at least a portion of the housing cavity 124 (FIG. 1) when the first and second housing shells 136, 138 are joined together.

The first housing shell 136 includes a main body 210, a neck section 212, and a plug collar 214. The second housing shell 138 also includes a main body 216 and a neck section 218. The second housing shell 138 is open-sided such that the second housing shell 138 forms a hollowed or recessed structure that includes a cavity portion 220 defined by the interior surface 168. Likewise, the first housing shell 136 is open-sided such that the first housing shell 136 forms a hollowed or recessed structure that includes a cavity portion 222 (shown in FIG. 4) defined by the interior surface 166. The neck section 212 joins the plug collar 214 to the main body 210. The plug collar 214 surrounds the longitudinal axis 194 and defines a collar cavity 224. In an exemplary embodiment, the collar cavity 224 is entirely surrounded and defined by the plug collar 214 of the first housing shell 136.

When the first and second housing shells 136, 138 are coupled together, the cavity portions 222, 220 of the respective first and second housing shells 136, 138 and the collar cavity 224 of the plug collar 214 combine to form the housing cavity 124. When coupled together, the main bodies 210, 216 directly oppose each other and the neck sections 212, 218 directly oppose each other. The main bodies 210, 216 combine to form the body portion 125 (FIG. 1) of the connector housing 122. The neck sections 212, 218 and the plug collar 214 combine to form the insert portion 123 (FIG. 1). More specifically, the neck sections 212, 218 and the plug collar 214 are configured to be inserted into the cavity (not shown) of the receptacle assembly 104 (FIG. 1). As shown, the plug collar 214 includes an entirety of the leading edge 130.

The first and second housing shells 136, 138 also have respective outer active surfaces 170, 172. The active surfaces 170, 172 have respective recess portions 174, 176. The recess portions 174, 176 are sized and shaped to receive the latch assembly 150 when the pluggable connector 106 is fully assembled. The active surface 170 also defines a majority of a runway 180. The runway 180 is configured to receive the operator-controlled actuator 152. The runway 180 may include a projection 182.

As shown in FIG. 2, the operator-controlled actuator 152 is a thin strap or tether having inner and outer surfaces 252, 254 and a connector end portion 256. The operator-controlled actuator 152 is dimensioned to permit the operator-controlled actuator 152 to slide within the runway 180 along the mating axis 191 (FIG. 1). During operation, the connector end portion 256 interfaces with the connector housing 122 and engages the latch assembly 150. For example, the connector end portion 256 may slide along each of the first and second housing shells 136, 138 and include a cam element 260 that engages the latch assembly 150. The connector end portion 256 also includes an opening 258 that is sized and shaped to receive the projection 182.

The connector retainer 146 includes a retainer clip or shroud 186 and a retainer extension 188. In the illustrated embodiment, the retainer clip 186 includes a plurality of retainer walls 190 that are interconnected and configured to surround an exterior of the connector housing 122. The retainer walls 190 define a channel or passage 274. In alternative embodiments, the retainer clip 186 may include only one retainer wall. For example, the single retainer wall may be disposed near the runway 180 when the pluggable connector 106 is fully assembled. In other embodiments, the retainer clip 186 may include only two or three retainer walls 190 without entirely surrounding the connector housing 122. As shown in FIG. 2, one or more of the retainer walls 190 may include wall tabs 196. The wall tabs 196 may be inwardly biased to flex into tab recesses 198 of the first housing shell 136. Although not shown, the second housing shell 138 may have similar tab recesses 198.

The retainer clip 186 is configured to directly engage the first and second housing shells 136, 138 to secure the first and second housing shells 136, 138 to each other. The retainer extension 188 extends in a forward direction along the mating axis 191 (FIG. 1). The retainer extension 188 includes the biasing fingers 154, 156 and a coupling tab 270. The coupling tab 270 is positioned between the biasing fingers 154, 156 and is separated from each of the biasing fingers 154, 156 by a gap or slot 272. As shown, the coupling tab 270 and the biasing fingers 154, 156 extend generally parallel to one another. For example, in the illustrated embodiment, the coupling tab 270 and the biasing fingers 154, 156 are stamped from a common sheet of material, such as sheet metal.

When fully assembled, the pluggable connector 106 includes the communication sub-assembly 230 disposed within the housing cavity 124 (FIG. 1). The communication sub-assembly 230 includes the circuit boards 126, 128, the insulated wires 232, and end portions of the communication cables 236. Each of the communication cables 236 includes a cable jacket 238 that surrounds a plurality of the insulated wires 232, and a cable overmold 240 that surrounds the cable jacket 238. The cable overmold 240 may be dimensioned with respect interior dimensions of the housing cavity 124 so that the cable overmold 240 is engaged by the interior surfaces 166, 168 when the pluggable connector 106 is formed.

Figure 3:
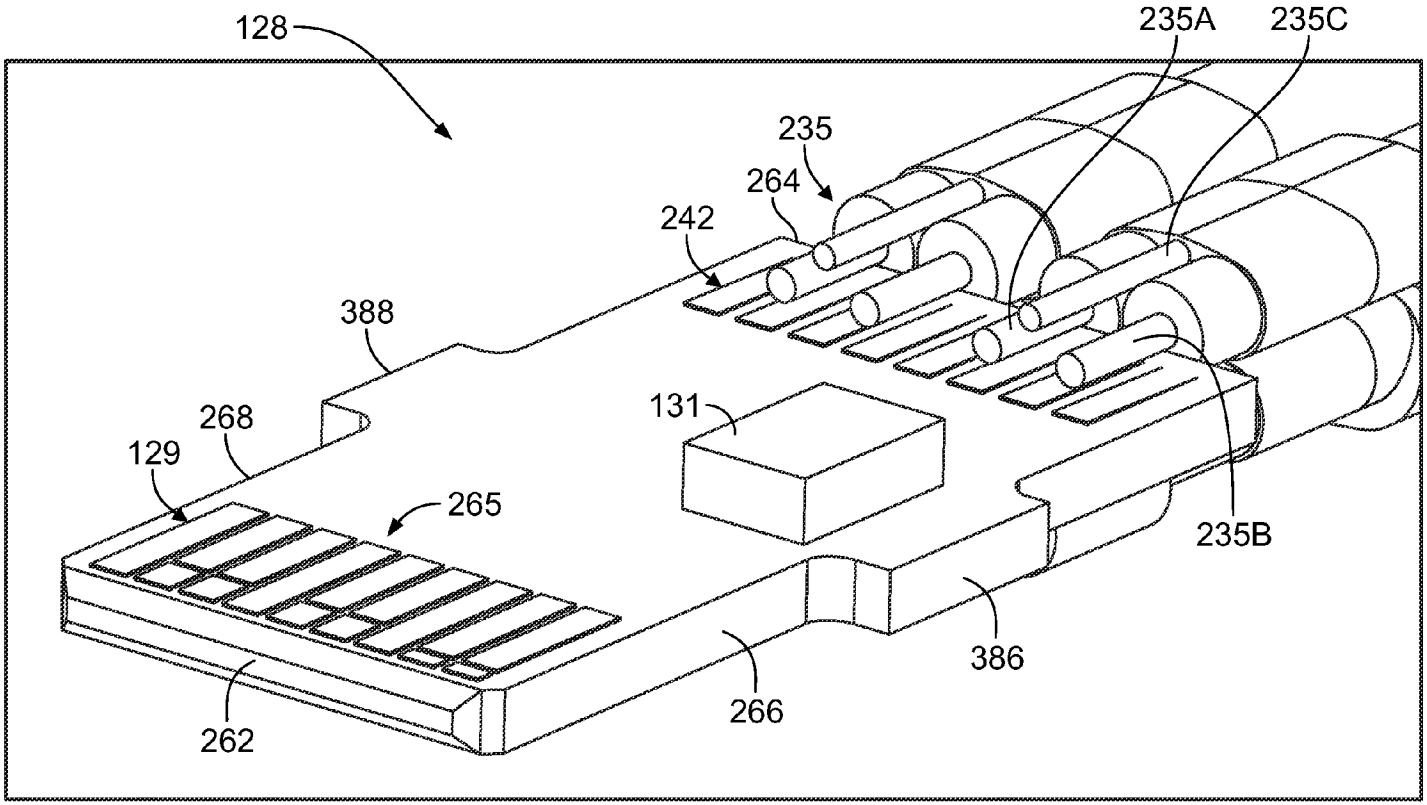
FIG. 3 is an isolated view of a circuit board that may be used by the pluggable connector of FIG. 1.

FIG. 3 is an enlarged view of the circuit board 128. Although the following is with reference to the circuit board 128, the circuit board 126 (FIG. 2) may have similar features and may be coupled to the communication cables 236 (FIG. 2) in a similar manner. The circuit board 128 includes a mating edge 262, a rearward facing edge 264, and a pair of side edges 266, 268. The side edges 266, 268 form lateral portions 386, 388, respectively, which are configured to engage the connector housing 122 (FIG. 1) as described below. The wire conductors 235 include signal conductors 235A, 235B that are terminated to electrical contacts 242 of the circuit board 128 extending along the rearward facing edge 264. The wire conductors 235 also include ground conductors 235C. Although not shown, the ground conductors 235C may be terminated to one of the electrical contacts 242 or other grounding feature (not shown). The electrical contacts 242 are electrically coupled to the electrical contacts 129 through the circuit board 128. One or more of the electrical contacts 129 may be communicatively coupled to a processing unit 131 disposed on the circuit board 128. The electrical contacts 129 and 242 are contact pads in the illustrated embodiment.

Also shown in FIG. 3, the mating edge 262 and the rearward-facing edge 264 face in opposite directions. The mating edge 262 is configured to engage the mating connector (not shown) within the receptacle assembly 104 (FIG. 1). The electrical contacts 129 form a contact array 265 that is disposed proximate to the mating edge 262. In the illustrated embodiment, the contact array 265 is part of the circuit board 128. In alternative embodiments, the contact array 265 may be formed from electrical contacts that are not part of a circuit board.

Returning to FIG. 2, to assemble the pluggable connector 106, the communication cables 236 and corresponding insulated wires 232 may be stripped to expose the wire conductors 235 (FIG. 3). The wire conductors 235 may be terminated to the corresponding electrical contacts 242 (FIG. 3) of the respective circuit boards 126, 128. For example, the wire conductors 235 may be soldered or otherwise held against the electrical contacts 242. Accordingly, the wire conductors 235 may be electrically coupled to the electrical contacts 127, 129 through the circuit boards 126, 128.

Before, after, or during the construction of the communication sub-assembly 230, the communication sub-assembly 230 (or components thereof) may be advanced through the channel 274 of the connector retainer 146. The communication sub-assembly 230 may be positioned between the first and second housing shells 136, 138. The first and second housing shells 136, 138 may be combined such that communication sub-assembly 230 is located within the housing cavity 124. As described in greater detail below, the second housing shell 138 may be rotated into position against the first housing shell 136 for some embodiments.

With the connector housing 122 assembled around the communication sub-assembly 230, the latch assembly 150 may then be positioned within the recess portions 174, 176. The connector end portion 256 of the operator-controlled actuator 152 may be positioned along the connector housing 122. The operator-controlled actuator 152 may be located above the latch assembly 150 such that the latch assembly 150 is located between the connector housing 122 and the connector end portion 256. In an exemplary embodiment, the cam element 260 is positioned to engage the latch assembly 150. The runway 180 receives the operator-controlled actuator 152, and the opening 258 receives the projection 182.

With the operator-controlled actuator 152 extending along the runway 180, the connector retainer 146 may be moved in a forward direction with the operator-controlled actuator 152 extending through the channel 274 of the retainer clip 186. The retainer extension 188 may slide along the outer surface 254 of the operator-controlled actuator 152 and over the opening 258 and the projection 182 until the biasing fingers 154, 156 engage the latch assembly 150. At this time, the connector housing 122 is received within the channel 274 of the retainer clip 186. The wall tabs 196 of the connector retainer 146 may engage the connector housing 122 and be deflected outwardly by the connector housing 122 as the connector housing 122 moves through the channel 274. The wall tabs 196 may then flex into the tab recesses 198. When engaged to the connector housing 122, the wall tabs 196 prevent the connector retainer 146 from being inadvertently removed from the connector housing 122. At some time during the assembly of the pluggable connector 106, the shield frames 142A, 142B (FIG. 1) are coupled to neck sections 218, 212, respectively.

It is understood that the above assembly process is only one possible method of assembling a pluggable connector, such as the pluggable connector 106. The assembly process may be different in other embodiments.

Figure 4:
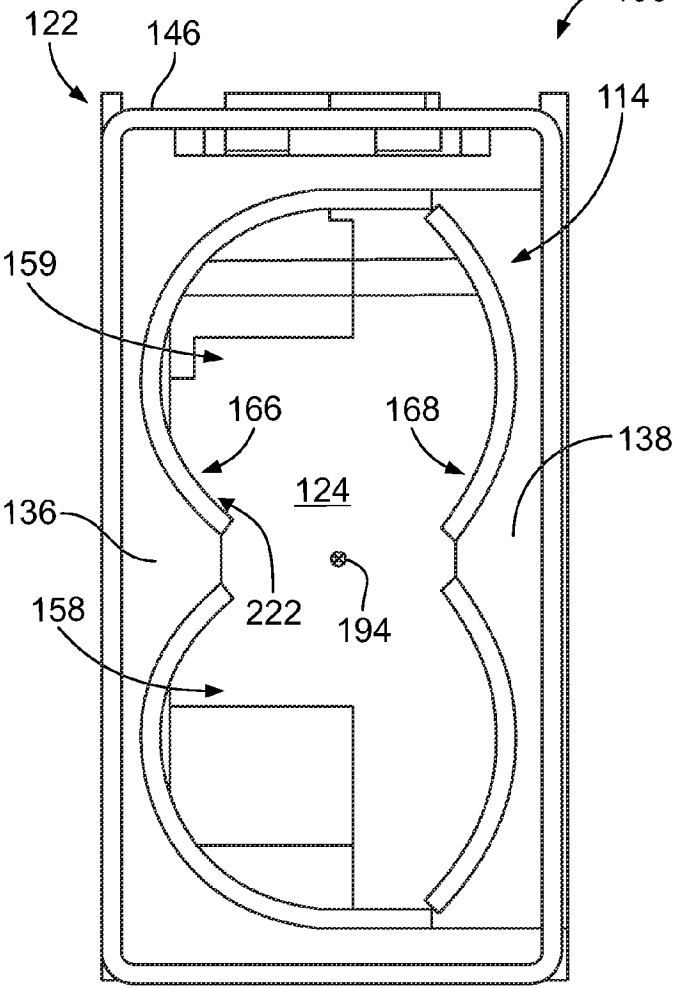
FIG. 4 is an end view of a portion of the pluggable connector of FIG. 1.

FIG. 4 is an end view of a portion of the pluggable connector 106 that illustrates the connector housing 122 and the connector retainer 146 at the trailing end 114. For illustrative purposes, the communication sub-assembly 230 (FIG. 2) and the communication cables 236 (FIG. 1) are not shown. The first and second housing shells 136, 138 are surrounded and held together by the connector retainer 146. The interior surfaces 166, 168 define a portion of the housing cavity 124 therebetween. As shown, the longitudinal axis 194 extends through an approximate center of the housing cavity 124. The connector housing 122 may include cable openings 158, 159 that receive portions of the corresponding communication cables 236.

In an exemplary embodiment, the first and second housing shells 136, 138 are joined together without using hardware. For example, the pluggable connector 106 may be devoid of any elongated fasteners, such as screws or plugs, that extend laterally through the housing cavity 124 (e.g., transverse to the longitudinal axis 194) to join the first and second housing shells 136, 138. In some embodiments, the first and second housing shells 136, 138 are secured together using only the connector retainer 146 and frictional resistance between engaged surfaces of the first and second housing shells 136, 138.

Figure 5:
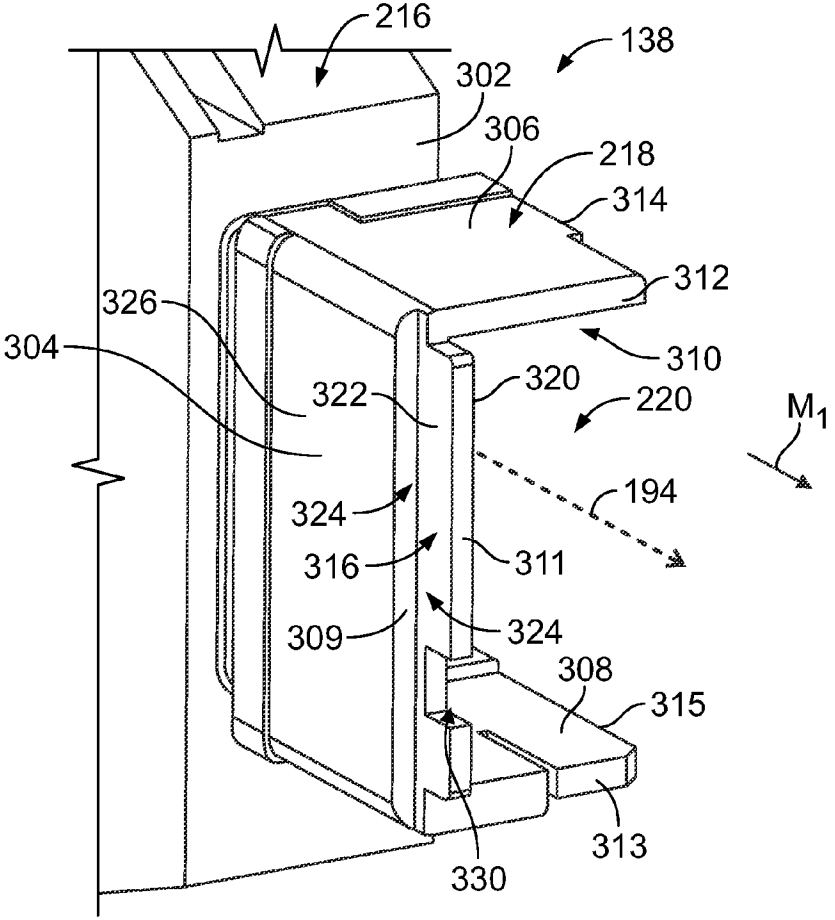
FIG. 5 is an isolated front-perspective view of a housing shell that may be used with the pluggable connector of FIG. 1.

FIG. 5 is an isolated front-perspective view of the second housing shell 138. The main body 216 includes a forward-facing body surface 302. The neck section 218 projects parallel to the longitudinal axis 194 from the body surface 302. The neck section 218 includes a sidewall 304 and wall portions 306, 308. The sidewall 304 extends between and joins the wall portions 306, 308. Each of the sidewall 304 and the wall portions 306, 308 has a substantially planar body that extends generally parallel to the longitudinal axis 194 when the pluggable connector 106 (FIG. 1) is fully assembled. The sidewall 304 and the wall portions 306, 308 partially surround the longitudinal axis 194. More specifically, the sidewall 304 and the wall portions 306, 308 form a portion of the hollowed or recessed structure that includes the cavity portion 220. Also shown, the sidewall 304 extends to a step surface 309. The wall portions 306, 308 include side edges 314, 315, respectively, which extend parallel to the longitudinal axis 194. The side edges 314, 315 face and border the first housing shell 136 (FIG. 1). The wall portions 306, 308 also include edge segments 312, 313, respectively.

The neck section 218 has a forward-facing front edge 310 that is collectively formed from the edge segments 312, 313 and an edge segment 311. The front edge 310 (or each of the edge segments 311-313) faces generally in the mating direction $M_1$ along the longitudinal axis 194. In an exemplary embodiment, the edge segments 312, 313 extend substantially parallel to the lateral axis 192 (FIG. 1), and the edge segment 311 extends generally parallel to the elevation axis 193.

Optionally, the neck section 218 includes a collar flange 316 that projects in the mating direction $M_1$ from the step surface 309 of the sidewall 304. In alternative embodiments, the collar flange 316 projects from the wall portion 306 or the wall portion 308. The collar flange 316 includes the edge segment 311 and has an inner flange surface 320 and an outer flange surface 322 with the edge segment 311 extending therebetween. In an exemplary embodiment, the edge segment 311 of the front edge 310 represents a portion of the second housing shell 138 that is proximal (or closest) to the mating end 112 (FIG. 1) of the pluggable connector 106. In some embodiments, the edge segment 311 may define a board notch 330. The edge segment 311 is configured to border or engage the circuit board 128 (FIG. 1) within the board notch 330.

The outer flange surface 322 faces away from the longitudinal axis 194. As shown, the outer flange surface 322 and the step surface 309 form an outer recess 324 of the neck section 218. The outer flange surface 322 is offset with respect to an outer wall surface 326 of the sidewall 304. The step surface 309 extends between the outer flange surface 322 and the outer wall surface 326. In some embodiments, the outer recess 324 receives a portion of the plug collar 214 (FIG. 1).

Figure 6:
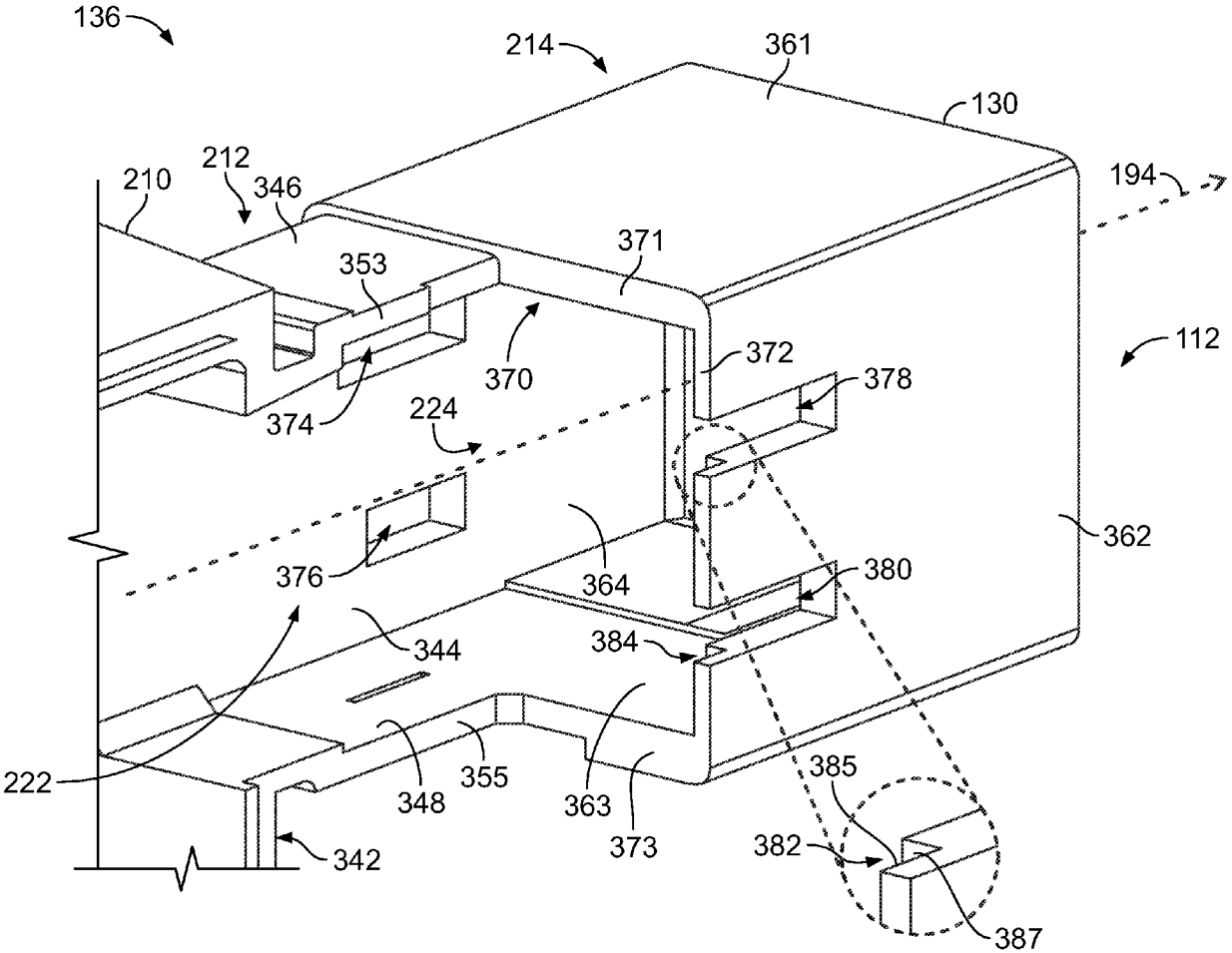
FIG. 6 is an isolated side-perspective view of another housing shell that may be used with the pluggable connector of FIG. 1.

FIG. 6 is an isolated side-perspective view of the first housing shell 136. The main body 210 includes a forward-facing body surface 342. The neck section 212 projects from the body surface 342 parallel to the longitudinal axis 194. The neck section 212 includes a sidewall 344 and wall portions 346, 348. The sidewall 344 extends between and joins the wall portions 346, 348. Each of the sidewall 344 and the wall portions 346, 348 has a substantially planar body that extends generally parallel to the longitudinal axis 194.

The sidewall 344 and the wall portions 346, 348 partially surround the longitudinal axis 194. More specifically, the sidewall 344 and the wall portions 346, 348 form a portion of the hollowed or recessed structure that includes the cavity portion 222. As shown, the wall portions 346, 348 have respective side edges 353, 355 that extend parallel to the longitudinal axis 194. The side edges 353, 355 are configured to interface with or border the side edges 314, 315 (FIG. 5), respectively, when the first housing shell 136 and the second housing shell 138 (FIG. 1) are coupled together.

The plug collar 214 is supported by the neck section 212. In the illustrated embodiment, the plug collar 214 includes a plurality of plug walls 361, 362, 363, 364 that extend lengthwise in a direction that is parallel to the longitudinal axis 194. The plug walls 362 and 364 oppose each other. The plug wall 364 extends from the sidewall 344 toward the mating end 112. As shown, the plug walls 361-364 surround the longitudinal axis 194 and define the collar cavity 224. In the illustrated embodiment, the plug walls 361-364 are substantially planar, but the plug walls 361-364 may have curved contours in other embodiments. In another embodiment, the plug collar may include a cylindrical plug wall. The first housing shell 136 may include or define an entirety of the mating end 112 of the pluggable connector 106. Unlike other pluggable connectors that include multiple housing shells, the plug collar 214 may completely surround the circuit boards 126, 128 (FIG. 1) proximate to the mating end 112. As such, it may not be necessary to use elongated fasteners that, for example, extend across and join the opposing plug walls 362, 364.

Each of the plug walls 361-364 includes a portion of the leading edge 130. The plug walls 361-363 include edge segments 371, 372, 373, respectively, that collectively define a back edge 370 of the plug collar 214. The leading edge 130 and the back edge 370 face in opposite directions with the plug walls 361-363 extending directly therebetween. The leading edge 130 may include the mating end 112, and the back edge 370 may face the trailing end 114 (FIG. 1). At least one or more of the edge segments 371-373 of the back edge 370 is configured to border the front edge 310 (FIG. 5) of the second housing shell 138 (FIG. 1). For example, the back edge 370 and the front edge 310 may directly engage each other or face each other with a small or nominal gap therebetween. In an exemplary embodiment, when the first and second housing shells 136, 138 are coupled together, the edge segment 371 borders the edge segment 312 (FIG. 5), the edge segment 372 extends along the collar flange 316 (FIG. 5) and faces the step surface 309 (FIG. 5), and the edge segment 373 borders the edge segment 313 (FIG. 5).

The plug wall 364 includes a pair of board slots 374, 376, and the plug wall 362 includes a pair of board slots 378, 380. The board slots 374, 376 are entirely defined by the plug wall 364. The board slots 378, 380, however, are open-ended along the edge segment 372. More specifically, the board slots 378, 380 may open toward the trailing end 114 (FIG. 1) and/or toward the front edge 310 of the second housing shell 138. The board slot 374 is laterally aligned with the board slot 378 such that the circuit board 126 (FIG. 1) may extend across the collar cavity 224 and be received by the board slots 374, 378. In a similar manner, the board slot 376 is laterally aligned with the board slot 380 such that the circuit board 128 (FIG. 1) may extend across the collar cavity 224 and be received by the board slots 376, 380.

In an exemplary embodiment, the plug wall 362 forms inner recesses 382, 384. The inner recesses 382, 384 are sized and shaped to receive the collar flange 316. For example, as shown in the enlarged view, the inner recess 382 is defined by a first recess surface 385 that faces toward the longitudinal axis 194 (or the plug wall 364) and a second recess surface 387 that faces along the longitudinal axis 194 toward the trailing end 114. The first recess surface 385 is configured to border the outer flange surface 322 (FIG. 5) of the collar flange 316, and the second recess surface 387 is configured to border the edge segment 311 (FIG. 5) of the collar flange 316. The inner recess 384 may also have first and second recess surfaces that are similar to the first and second recess surfaces 385, 387.

Figure 7:
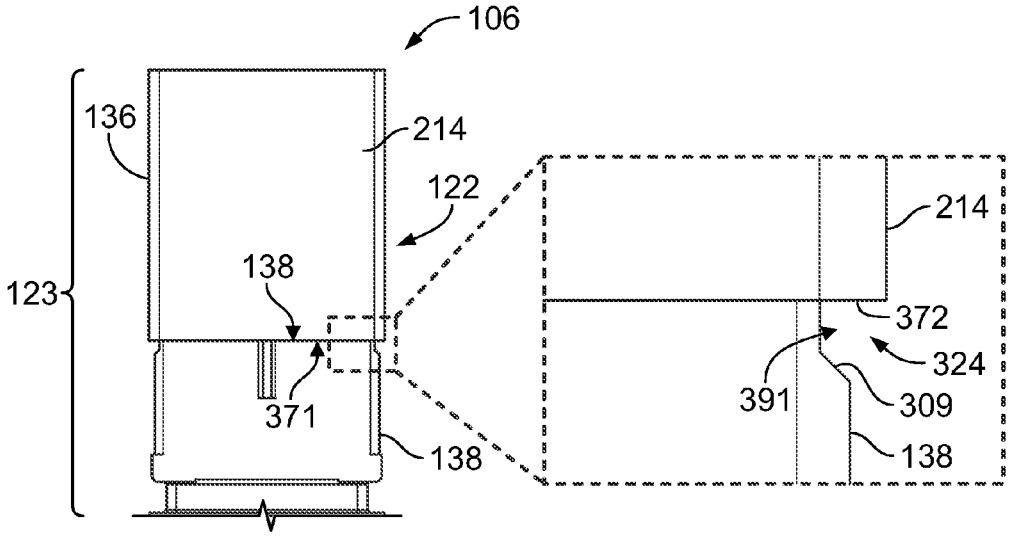
FIG. 7 is a top view of a portion of the pluggable connector of FIG. 1.

FIG. 7 is a top view of the pluggable connector 106 and, particularly, the insert portion 123 of the pluggable connector 106. For illustrative purposes, the shield frames 142A, 142B (FIG. 2) and the latch assembly 150 (FIG. 2) are not shown. When the first and second housing shells 136, 138 are coupled to form the connector housing 122, the plug collar 214 is positioned in front of the second housing shell 138. For instance, the edge segment 312 of the second housing shell 138 borders the edge segment 371 of the first housing shell 136. As shown in the enlarged portion of FIG. 7, the plug wall 362 is positioned within the outer recess 324 of the second housing shell 138. In some embodiments, the plug wall 362 may occupy only a portion of the outer recess 324 such that a gap 391 exists between the step surface 309 and the edge segment 372. In some embodiments, the gap 391 may receive a portion of the shield frame 142A (FIG. 2).

Figure 8:
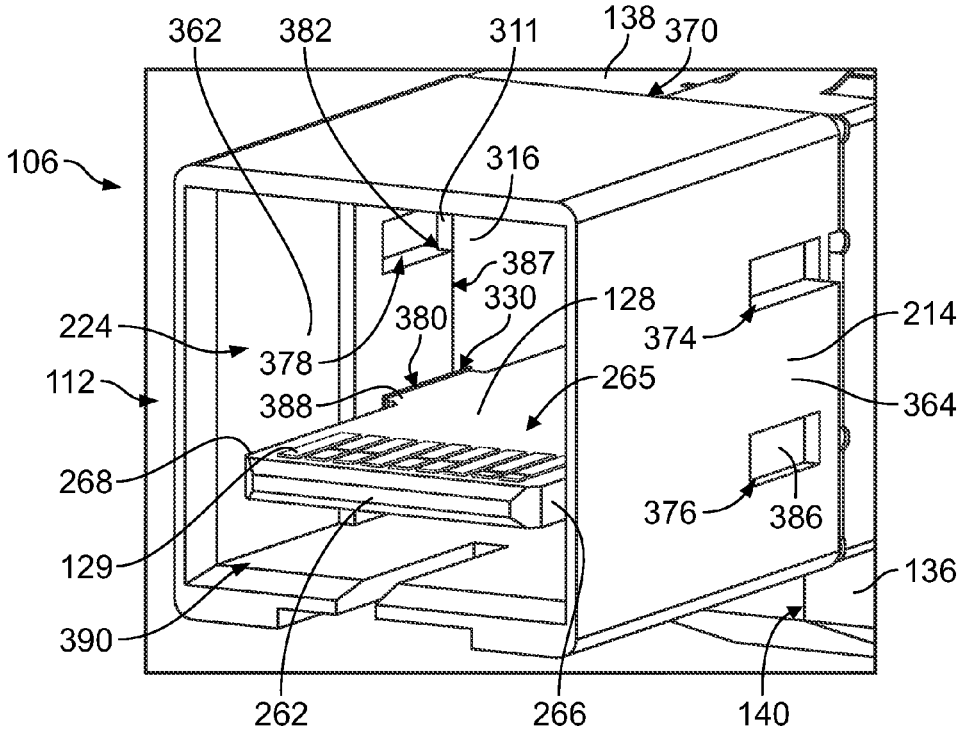
FIG. 8 is a front perspective view of a portion of the pluggable connector of FIG. 1.

FIG. 8 is a perspective view of a portion of the pluggable connector 106. The circuit board 128 is disposed within the collar cavity 224 of the plug collar 214. For illustrative purposes, the circuit board 126 (FIG. 1) has been removed. When the first and second housing shells 136, 138 are joined together along the seam 140, the second housing shell 138 interfaces with the back edge 370 of the plug collar 214 such that the plug collar 214 extends from the second housing shell 138 to the mating end 112. In particular embodiments, the collar flange 316 is positioned within the inner recess 382 and the edge segment 311 is engaged with the second recess surface 387. The edge segment 311 encloses the open-ended board slots 378, 380.

As shown in FIG. 8, the plug collar 214 surrounds the contact array 265. In the illustrated embodiment, the contact array 265 of the electrical contacts 129 is part of the circuit board 128. In other embodiments, a contact array having discreet electrical contacts that are not part of a circuit board may be disposed within the collar cavity 224. For example, the contact array may include a two-dimensional array of pin contacts.

In the illustrated embodiment, the mating edge 262 of the circuit board 128 is positioned proximate to an opening 390 to the collar cavity 224. The side edges 266, 268 extend along and adjacent to the plug walls 364, 362, respectively. In such embodiments, the plug collar 214 may engage each of the side edges 266, 268 to hold the circuit board 128 within the collar cavity 224. The circuit board 128 includes lateral portions 386, 388 that are received by the board slots 376, 380, respectively, of the plug collar 214. In some embodiments, the front edge 310 (FIG. 5) engages at least one of the circuit boards 126, 128 to hold the circuit board in a designated position. For example, the edge segment 311 may engage the lateral portion 388 of the circuit board 128. For example, the edge segment 311 may provide a backstop that engages the lateral portion 388 when the lateral portion 388 is positioned within the board slot 380. As shown, the board notch 330 may receive the lateral portion 388. The edge segment 311 may block the circuit board 128 from moving backward toward the trailing end 114 (FIG. 1) along the longitudinal axis 194 (FIG. 1) when the pluggable connector 106 is mated with the communication component 104 (FIG. 1). The board slots 374, 378 may be configured in a similar manner to hold the circuit board 126 within the collar cavity 224.

Figure 9:
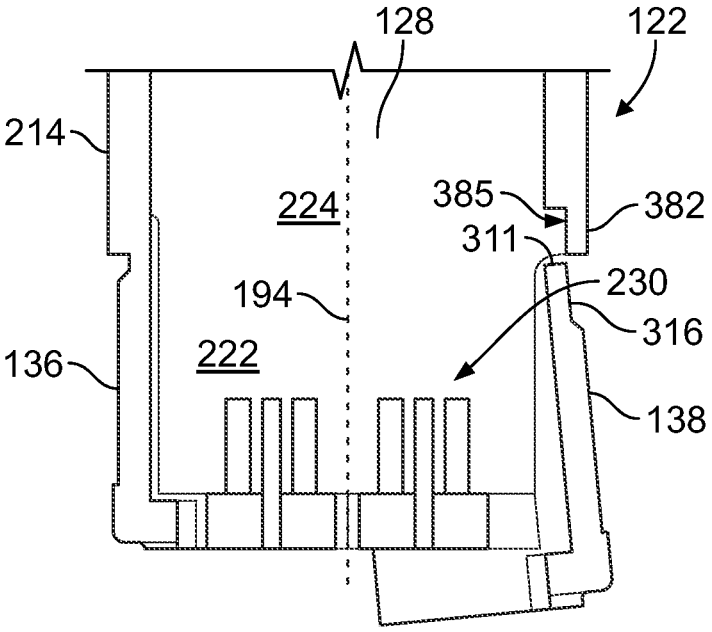
FIG. 9 is a cross-sectional view of a portion of the pluggable connector illustrating an assembly stage in which the housing shell of FIG. 5 is mated with the housing shell of FIG. 6.
Figure 10:
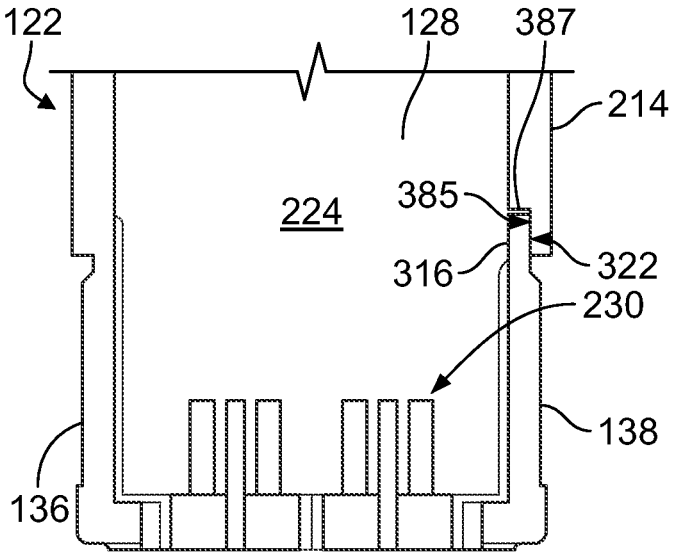
FIG. 10 is a cross-sectional view of a portion of the pluggable connector showing the housing shells joined together.

FIG. 9 is a cross-sectional view that illustrates an assembly stage just prior to the second housing shell 138 being mated with the first housing shell 136 to form the connector housing 122. FIG. 10 is the cross-sectional view of the fully assembled connector housing 122. As shown, the circuit board 128 is positioned within the collar cavity 224 of the plug collar 214. At the assembly stage shown in FIG. 9, the communication sub-assembly 230 is positioned within the cavity portion 222 of the first housing shell 136. At such time, the circuit board 126 (FIG. 1) and the circuit board 128 are loosely held by the plug collar 214.

In some embodiments, the second housing shell 138 may be configured to slide into an intermediate position with respect to the first housing shell 136 and then rotate to a final assembled position. For example, the second housing shell 138 may be oriented with respect to the first housing shell 136, as shown in FIG. 9, such that the edge segment 311 may be inserted underneath the first recess surface 385. The collar flange 316 may be angled with respect to the longitudinal axis 194 as shown in FIG. 9. As the collar flange 316 is advanced in the mating direction $M_1$ (FIG. 10) underneath the first recess surface 385, the second housing shell 138 may be rotated toward the first housing shell 136 as indicated by the arrow R (FIG. 10). As shown in FIG. 10, after the first and second housing shells 136, 138 are joined together, the first recess surface 385 interfaces with the outer flange surface 322. At this time, the edge segment 311 (FIG. 9) may directly interface with the second recess surface 387 and the circuit boards 126, 128 to hold the circuit boards 126, 128 in the designated mating positions.

Although the illustrated embodiment has been described as including the collar flange 316, other embodiments may not include the collar flange 316. In such embodiments, the back edge 370 (FIG. 6) of the plug collar 214 may border at least a portion of the front edge 310 (FIG. 5) without the plug collar 214 or the back edge 370 overlapping the second housing shell.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A pluggable connector comprising:

a circuit board including a contact array of contact pads for engaging corresponding contacts of a communication component; and a connector housing having a mating end configured to mate with the communication component, the connector housing including a first housing shell and a second housing shell that oppose each other and are coupled together to define a housing cavity therebetween, the contact array being disposed within the housing cavity, the first housing shell including a plug collar that surrounds the contact array at the mating end, the plug collar having a leading edge and a back edge, the second housing shell interfacing with the back edge of the plug collar such that the plug collar extends from the second housing shell to the mating end, the second housing shell includes a forward-facing front edge that directly engages the circuit board, wherein the contact pads of the circuit board are exposed at the mating end of the connector housing such that the contact pads are capable of engaging the corresponding contacts of the communication component during a mating operation between the communication component and the pluggable connector.

2. The pluggable connector of claim 1, wherein the connector housing has a trailing end and a central longitudinal axis that extends between the mating and trailing ends through the housing cavity, the plug collar surrounding the longitudinal axis and having at least one plug wall that extends substantially parallel to the longitudinal axis, the pluggable connector further comprising a cable that is coupled to and/or inserted through the trailing end and communicatively coupled to the contact pads.

3. The pluggable connector of claim 2, wherein the at least one plug wall includes multiple plug walls that extend substantially parallel to the longitudinal axis.

4. The pluggable connector of claim 2, wherein the leading edge completely surrounds the longitudinal axis.

5. The pluggable connector of claim 2, wherein the circuit board has opposite side edges with the contact array positioned therebetween, wherein the plug wall directly engages at least one of the side edges to hold the circuit board.

6. The pluggable connector of claim 1, wherein the plug collar defines a collar cavity where the contact array is disposed, the pluggable connector being devoid of any fasteners that extend through the collar cavity.

7. The pluggable connector of claim 1, wherein the first housing shell includes a main body and a neck section that is open-side, the neck section extending between and joining the main body and the plug collar.

8. The pluggable connector of claim 1, further comprising a connector retainer that includes a discrete retainer clip that engages each of the first and second housing shells and secures the first and second housing shells together, the retainer clip surrounding at least a portion of the first housing shell and at least a portion of the second housing shell.

9. The pluggable connector of claim 1, wherein the circuit board includes a mating edge that is disposed at the mating end of the connector housing, the contact pads being proximate to the mating edge.

10. The pluggable connector of claim 1, wherein the connector housing has a trailing end and a central longitudinal axis that extends between the mating and trailing ends through the housing cavity, the pluggable connector further comprising a cable that is coupled to and/or inserted through the trailing end and is communicatively coupled to the contact pads, wherein the connector housing includes an insert portion that is sized and shaped to be inserted into a cavity of a receptacle assembly.

11. The pluggable connector of claim 10, further comprising a shield frame that surrounds the insert portion, the shield frame configured to electrically engage the receptacle assembly and ground the pluggable connector thereto.

12. A pluggable connector comprising:

a circuit board including a contact array of electrical contacts configured to engage corresponding contacts of a communication component; and a connector housing including a first housing shell and a second housing shell that oppose each other and are coupled together to define a housing cavity therebetween, the circuit board being disposed in the housing cavity, the connector housing having a mating end and a trailing end and a central longitudinal axis extending therebetween through the housing cavity, the second housing shell including a front edge that faces toward the mating end and directly engages the circuit board, the front edge of the second housing shell configured to block the circuit board from moving backward toward the trailing end during a mating operation with the communication component.

13. The pluggable connector of claim 12, wherein the first housing shell includes a plug collar that surrounds the circuit board at the mating end, the plug collar having a leading edge and a back edge, the second housing shell interfacing with the back edge of the plug collar such that the plug collar extends from the second housing shell to the mating end.

14. The pluggable connector of claim 12, wherein the first housing shell includes a plug collar that is configured to mate with the communication component, the circuit board including opposite side edges with the contact array positioned therebetween, the plug collar engaging each of the side edges.

15. The pluggable connector of connector of claim 12, wherein the first housing shell includes a plug wall that extends parallel to the longitudinal axis and includes a board slot that opens toward the trailing end of the connector housing, the board slot receiving a lateral portion of the circuit board that extends laterally away from the longitudinal axis, the front edge of the second housing shell engaging the lateral portion to hold the circuit board within the board slot.

16. The pluggable connector of claim 12, wherein the front edge of the second housing shell includes an edge segment that directly engages and blocks the circuit board from moving backward, the edge segment constituting a portion of the second housing shell that is closest to the mating end.

17. The pluggable connector of claim 12, wherein the electrical contacts are contact pads of the circuit board, the contact pads being exposed at the mating end of the connector housing, such that the contact pads are capable of engaging the corresponding contacts of the communication component during the mating operation between the communication component and the pluggable connector.

18. A pluggable connector comprising:

a contact array of electrical contacts for engaging corresponding contacts of a communication component; and a connector housing having a mating end configured to mate with the communication component, the connector housing including a first housing shell and a second housing shell that oppose each other and are coupled together to define a housing cavity therebetween, the contact array being disposed within the housing cavity, the first housing shell including a plug collar that surrounds the contact array at the mating end, the plug collar having a leading edge and a back edge, the second housing shell interfacing with the back edge of the plug collar such that the plug collar extends from the second housing shell to the mating end, wherein the first housing shell includes a main body and a neck section that are each open-sided, the neck section joining the main body and the plug collar of the first housing shell.

19. The pluggable connector of claim 18, wherein the second housing shell includes a neck section that is open-sided and engages the neck section of the first housing shell to define a portion of the housing cavity therebetween, wherein the plug collar and the neck sections of the first and second housing shells are configured to be inserted into a cavity of the communication component.

* * * * *